US005188679A

United States Patent [19]

Kretchmer

[11] Patent Number: 5,188,679

[45] Date of Patent: * Feb. 23, 1993

[54] METAL COMPRESSION-SPRING GEMSTONE MOUNTINGS

[76] Inventor: Steven D. Kretchmer, 16837 Magnolia Blvd., Encino, Calif. 91316

[ * ] Notice: The portion of the term of this patent subsequent to Jan. 28, 2009 has been disclaimed.

[21] Appl. No.: 820,766

[22] Filed: Jan. 15, 1992

Related U.S. Application Data

[63] Continuation-in-part of Ser. No. 601,472, Oct. 19, 1990, Pat. No. 5,084,108, which is a continuation-in-part of Ser. No. 555,127, Jul. 19, 1990, abandoned.

[51] Int. Cl.[5] ..... C21D 9/00

[52] U.S. Cl. ..... 148/538; 148/678; 63/26; 63/15

[58] Field of Search ..... 63/26, 29.1, 31, 15; 148/678, 538

[56] References Cited

U.S. PATENT DOCUMENTS 3,141,799 8/1958 Brellier et al. ..... 148/11.5 R

FOREIGN PATENT DOCUMENTS 59-76843 5/1984 Japan ..... 420/466

OTHER PUBLICATIONS

B. A. Rogers, "The Nature of Metals", pp. 120–128, (Am. Soc'y for Metals & Iowa State Univ. Press (1964).

A. T. Kok, "A Few Hard Facts", pp. 19–22, Aurum 3, (The International Gold Corporation 1980).

M. Basset, "A Few More Hard Facts", pp. 3–19, Aurum 3, (The International Gold Corporation 1980).

M. F. Grimwade, "Basic Metallurgy for Goldsmiths-VII", pp. 51–57, Aurum 6 (The International Gold Corporation 1981).

C. P. Susz et al., "Heat Treatment of 14 Carat Gold Alloy", 17–25, Aurum 11 (The International Gold Corporation 1981).

Brochure, "Niessing Rings 1988" (published in German), Niessing GmbH & Co. (The International Gold Corporation 1982).

Brochure, "Niessing Rings 1988" (published in English), Niessing GmbH & Co. 1988.

Brochure, "Neissing Original Tension Rings", Niessing GmbH & Co. 1988.

E. M. Wise, "Gold-Recovery, Properties, and Applications", pp. 244–246, (D. Van Nostrand Co., Inc. 1964).

R. F. Vines et al., "The Platinum Metals and Their Alloys", pp. 66–70, (The International Nickel Co., Inc. 1941).

*Primary Examiner*—Deborah Yee

*Attorney, Agent, or Firm*—Pennie & Edmonds

[57] ABSTRACT

A precious metal alloy compression-spring gemstone mounting is made by casting or working a quantity of alloy to form a gemstone mounting in a desired configuration, followed by annealing and heat-treating the mounting to increase its yield strength. A stone is then placed in the mounting and is retained therein by compressive spring force.

10 Claims, 2 Drawing Sheets

METAL COMPRESSION-SPRING GEMSTONE MOUNTINGS

CROSS-REFERENCE TO RELATED APPLICATIONS

This is a continuation-in-part of application Ser. No. 07/601,472, filed Oct. 19, 1990, now U.S. Pat. No. 5,084,108, which is a continuation-in-part of application Ser. No. 07/555,127, filed Jul. 19, 1990, abandoned.

BACKGROUND OF THE INVENTION

1. Technical Field

The present invention relates to metal alloys used to make compression-spring mountings for stones used in jewelry and art objects. In addition, the invention relates to a method of forming heat-treatable metal compression-spring gemstone mountings.

2. Background Art

It is known in the jewelry art how to make prong-settings settings for precious and semi-precious stones. It is also known how to set such gemstones by raising metal around a stone to secure it in position, such as in bead-setting or bezel-setting.

It is also known in the jewelry-making art that the hardness and strength of alloys are increased by cold deformation. That is, it is known how to work-harden gold and platinum alloys by various forging processes to increase yield strength so as to create spring pressure. This spring pressure can be used to mount and center stones in rings, pendants, bracelets, etc. The pressure needed to hold the stone securely in place is supplied by the springiness inherent in the structure of the worked precious metal jewelry piece itself.

It is also known to those interested in the metallurgy of precious metals that many gold alloys and certain platinum alloys can be age-hardened by heat treatments to increase their hardness and yield strength, sometimes even more than is possible through cold working.

Conventional compression-spring gemstone mounting techniques have certain advantages over the more traditional prong settings because:

Often, more of the surface area of the girdle (peripheral edge) of the gemstone is held by the compression-spring mounting.

When struck with unusual force, a prong-mounted stone can shift and loosen when the prongs bend, but a compression-spring-set stone is held securely in its seat by spring pressure.

Besides the advantageous mechanical properties of compression-spring-set stones, this type of mounting exposes the stone to more light, thereby better bringing out the reflections and colors that are often hidden by prongs.

On the other hand, the work-hardening process for manufacturing compression-spring settings limits many of the possibilities for the design of jewelry or art objects. For example:

It is risky to bend spring-hard alloys to make adjustments because the metal is susceptible to fracturing without prior annealing. And, if the alloys are brought to annealing temperatures after they have been work-hardened, they will lose their hardness and become malleable. The stone will no longer be held by spring power, and the piece would be ruined.

The hardness and strength of the alloys are increased by cold deformation. The piece must be forged to shape to make it hard, like when a coin is struck, or when a ring is pounded on a mandrel with a hammer, etc. The spring power is arrived at with difficulty by working and shaping the piece, sometimes necessitating expensive presses and dies.

Standard jewelry soldering techniques cannot be applied to work-hardened compression-spring jewelry, because soldering temperatures anneal the alloy. Repairs requiring heat cannot be done without costing the metal its spring power. Jewelry designs utilizing compression-spring-set mountings therefore tend to be quite limited.

Accordingly, it is an object of the present invention to provide a method for forming metal compression-spring gemstone mountings having the advantages and being free of the drawbacks referred to above that are inherent in prior art methods for making compression-spring mountings.

Another object is to provide new and useful metal compression-spring gemstone mountings having the advantages and being free of the drawbacks referred to above that are inherent in prior art compression-spring mountings.

These and other objects of the invention as well as the advantages thereof can be had by reference to the following description, drawings and claims.

SUMMARY OF THE INVENTION

The foregoing objects are achieved according to the present invention by a method for forming heat-treatable metal compression-spring gemstone mountings comprising the steps of casting or working the metal to form the gemstone mounting by standard jewelry techniques; annealing (solution treating) the mounting, and heat-treating (controlled precipitation) the mounting to significantly increase the yield strength.

The invention is preferably (but not necessarily only) applied to 14 karat gold alloys, 18 karat gold alloys and platinum alloys that can be cast to a desired form or worked in an annealed state, then heat-treated and age-hardened to significantly increase their yield strengths so that they become spring-like, and can be used for compression-spring settings for gemstones and the like. These alloys can be repeatedly annealed and heat treated/age hardened, and will actually increase in strength at room temperature over time. As used herein, the term "age hardening" is essentially synonymous with the term "precipitation hardening" which results from the formation of tiny particles of a new constituent (phase) within a solid solution. The presence of these particles create stress within the alloy and increase its yield strength. See, B. A. Rogers, "The Nature of Metals", p. 310 (Iowa State University Press, 1964); H. W. Pollock, "Materials Science and Metallurgy", p. 266 (Reston Pub. Inc. 1981) and "The Metals Handbook", pp. 1–2 (Am. Soc'y Metals, 1986).

BRIEF DESCRIPTION OF THE DRAWINGS

Preferred embodiments of the present invention are illustrated in the accompanying drawings wherein.

DESCRIPTION OF THE PREFERRED EMBODIMENTS OF THE INVENTION

Figure 1:
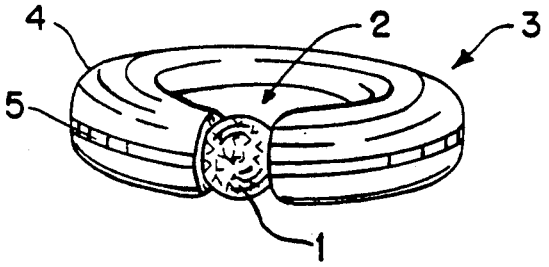
FIG. 1 is a perspective view of a dual alloy (4 and 5) ring in a plane, open-ended configuration having mounted between the opposing ends thereof a round-cut gemstone compression-spring-set according to the present invention.
Figure 2:
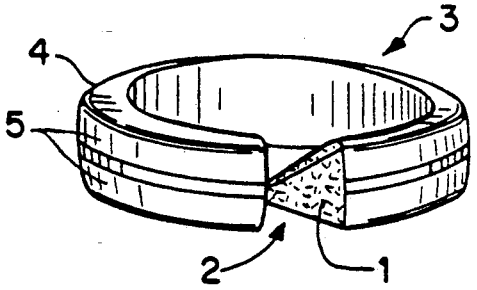
FIG. 2 is a perspective view of a dual alloy (4 and 5) ring in a plane, open-ended configuration having a triangular-cut gemstone compression-spring-set between the opposing ends of the ring according to the invention.
Figure 3:
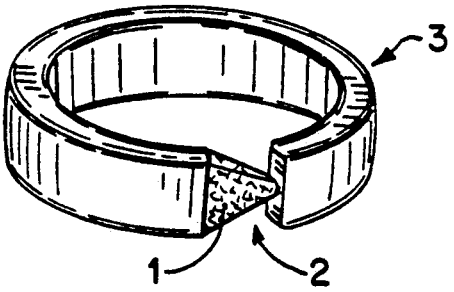
FIG. 3 is a perspective view of a single gold alloy ring in a plane, open-ended configuration having a triangular-cut gemstone compression-spring-set between the opposing ends of the ring according to the invention.
Figure 4:
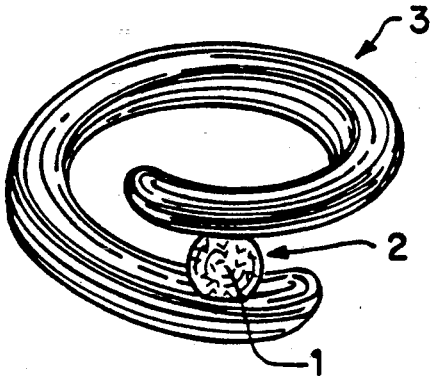
FIG. 4 is a perspective view of a single gold alloy ring in spiral, open-ended configuration having a round-cut gemstone compression-spring-set between, and near the ends of, opposing sides of the ring according to the present invention.
Figure 5:
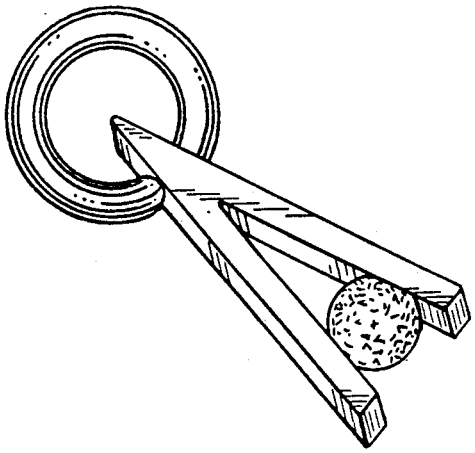
FIG. 5 is a perspective view of a V-shaped gold alloy gemstone mounting having a round-cut gemstone compression — spring-set between the ends of the V for use as an earring.
Figure 6:
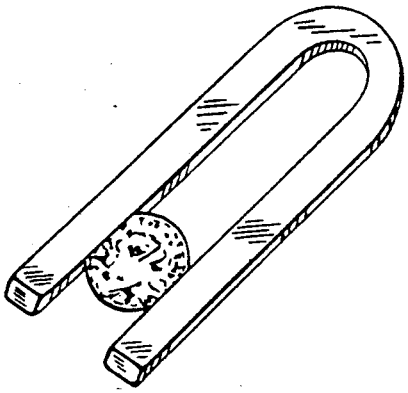
FIG. 6 is a perspective view of a U-shaped gold alloy gemstone mounting having a round cut gemstone compression-spring-set between the ends of the U for use as an earring.
Figure 7:
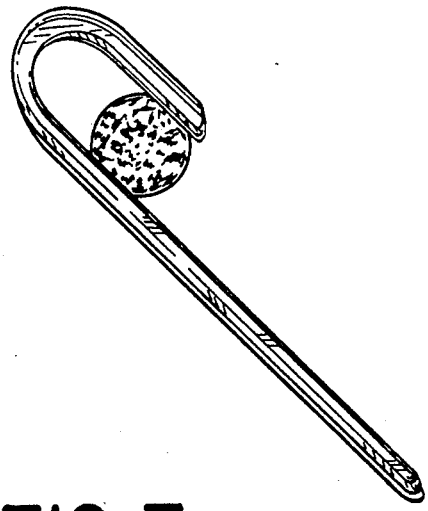
FIG. 7 is a perspective view of a J-shaped gold alloy gemstone mounting having a round cut gemstone compression-spring-set between the ends of the J for use as a pin or pendant.

The 14 karat gold alloys, 18 karat gold alloys and platinum alloys can be cast or worked to form jewelry or art objects in an annealed state, then increased in hardness and yield strength significantly by a heat-treatment. A groove or notch can be made in the cast shape or cut to position a gemstone in a gap left for it, allowing the compression-spring power in the structure of the precious metal piece itself to hold the stone securely in place. This is exemplified in the rings shown in FIGS. 1–4 and the other gemstone mountings shown in FIGS. 5–7. These type settings not only have excellent mechanical properties, but also permit more light to enter the stone, thereby enhancing its brilliance. The use of heat-treatable precious metal alloys is superior to, and addresses the disadvantages of, previously known methods of creating compression-spring mountings, such as work-hardening, and greatly expands the limits of jewelry design.

In their as-cast state, the alloys can be cast into a multitude of forms that after heating treatment, can hold stones by significant compression-spring power. Or, in their annealed state the alloys can be worked by standard jewelry-making techniques: they can be rolled, drawn, soldered to, shaped, bent, stamped, etc. These alloys can be applied to a variety of designs for gemstone mountings in rings, pendants, bracelets, precious metal art objects, and the like. For example, as shown in each of FIGS. 1–4, stone 1 can be securely mounted in the gap 2 of ring 3 that does not close in a full circle.

It should be noted that in designing the structure of the jewelry or art object, the smallest cross-sectional area and shape of a compression-spring mounting is taken into account. For example, the cross-section area of a 14K yellow gold (alloy No. 3 in Table 1) round wire to make a ring of an inside diameter of ¾ inch should be about 5.7 mm square to guarantee a better than sufficient strength to hold a 6 mm diameter stone securely as previously described. The pieces can be completely finished, and it is only necessary to groove a seat in the walls of the gap to secure the positioning of the stone before heat-treating to obtain spring strength. The gap for the stone should be closed narrower than the diameter or width of the stone itself so that the pressure holding the stone is at a maximum after heat-treatment.

To set the stone after the piece is age-hardened, the gap is widened so that the stone can just pass the opening and be positioned in its grooved seat. This can be done with wedges (for example in the case of the finger ring shown in FIG. 4) or, as in the case of finger-rings shown in FIGS. 1–3, by forcing the ring, pushing it down on a tapered jeweler's ring mandrel or by using various other forms of leverage. The wedges are removed, or the ring is carefully slipped off the mandrel and the stone is thereafter held by compression.

Other forms of leverage that are useful in setting the stone include the use of reverse pliers, a cone, a ring stretcher, or the like. In addition, one end of the wire can be held in a vise or other securing means, while the opposite end is opened using conventional pliers or other tools. After the stone is set in place, the leverage force is removed and the stone is held by compression. In fact, the power of the spring gold or platinum maintains the stone in its seat so well, that it is not possible to remove it without tools.

It is possible to adapt the design of the compression-spring mounting and groove to hold almost any shaped stone or stones securely, so long as the stone material (diamonds, ruby, sapphire and many other softer stones) is hard and tough enough so as not to be crushed or otherwise damaged by the compressive force of the spring mounting. The basic forms of compression-spring settings can vary, from simple ring-shapes (see, FIGS. 1–3) to more complex helixes (see, FIG. 4), V-shapes (FIG. 5), U-shapes (FIG. 6), J-shapes (FIG. 7), and the like. A wide variety of other shapes are also suitable, provided that the mounting has first and second ends which are spaced by a gap within which one or more gemstones can be secured retained therein. Objects can be earrings, pendants, chain-links, brooches, and a multitude of others. Standard jewelry soldering techniques can be applied and repairs requiring heat can be carried out. The alloys can be shaped, bent, built onto, annealed, and when the piece is done and the stone is to be set, the spring power can be regained by heat-treatment.

The hardness and strength of the alloys are increased by a simple heat-treatment. The piece need not be forged to shape, like a coin is struck, or a ring pounded on a mandrel with a hammer, etc. Rather, the piece can be cast to a desired shape, or worked to its finished form before spring power is produced in it, and then the stone can be secured into its seat.

Not only does the technique of the present invention for compression-spring stone settings allow more possibilities than prior art work-hardening techniques for obtaining spring power, but the equipment involved is more economical. Instead of presses, dies, and drop-hammers to create spring power for a production of pieces, a simple electric furnace, hot oil bath, or the like, is all that is required.

Many 14K alloys are heat treatable. Most karat gold colors are made by adding copper or silver, thereby imparting a red or green color, respectively. Yellow 14K gold is created by using close to equal parts of copper and silver. Small amounts of zinc are usually added as de-oxidant and have no significant effect on the hardening properties of these alloys.

Standard color 14K gold alloys made of gold, copper or silver wherein the silver content is 5% by weight or less cannot be hardened by heat treatment. Alloys where the copper content is 5% or less likewise cannot be hardened by heat treatment. The spring power imparted by heat-treatment becomes more effective approaching equal parts of copper and silver and are suitable for spring-gold alloys. Standard 14K nickel-white gold alloys are not heat-treatable and are unsuitable for use as spring-golds. Other 14K alloy suitable for spring golds are those made with additions of iron, titanium, cobalt, platinum or other elements.

Many 18K gold alloys are heat-treatable according to the present invention. Of the gold-silver-copper alloys, the more copper, the redder the color, and the harder and springier it will become after heat-treatment. Alloys having a silver content higher than half the alloy content begin to be too soft to be suitable as spring-gold alloys for objects such as women's finger rings according to the invention.

Other 18K gold alloys are also suitable for making mountings, such as alloys made with additions of iron, titanium, cobalt, platinum, and other elements.

Examples of alloying elements added to platinum that will allow age-hardening are the following:

Copper 5% to 25% Mildly age-hardenable.

Gold: 5% to over 50%. Max. about 35%.

Significantly age-hardenable.

Iridium: 10% to 40%. Mildly age-hardenable.

Iron: 10% to 70%. Max. at 30%.

Significantly age-hardenable.

Silver: 7% to 35%. Significantly age-hardenable.

Various other elements can create precipitation hardening when alloyed with platinum.

Listed below in Table 1 in order of decreasing strength are preferred examples of alloys that can be brought to high spring power.

TABLE 1

| | | | Content (Weight %) | | | | |
|---|---|---|---|---|---|---|---|
| Alloy No. | KT | COLOR | Au | Ag | Cu | Ni | Zn |
| 1 | 18K | White | 75 | — | 2 | 18 | 5 |
| 2 | 18K | Red | 75 | 2 | 23 | — | — |
| 3 | 14K | Yellow | 58.5 | 19 | 20 | — | 2.5 |
| 4 | | White | 90% Platinum/10% Gold | | | | |

There are three basic steps when using construction methods to make gemstone mounting shape made of heat treatable precious metal spring alloys according to the present invention. First, after the ingot is poured, the alloy should be cold-work reduced in cross-sectional dimension before construction is begun, that is, it must be rolled or drawn down (broken down). Second, after the piece is constructed by standard jewelry fabrication techniques and is in its final form, the piece must be completely annealed before heat-treatment (solution treating). Third, it must be heat-treated in an oven for a certain amount of time (controlled precipitation). It can then be cooled to ambient temperature.

In the case of as-cast compression-spring gemstone mounting shapes made of heat-treatable alloys, there are two basic steps to increase their spring power according to the present invention. After it is in its final form, the piece must first be completely annealed before heat-treatment (solution treating). Second, it must be heat-treated in an oven for a certain amount of time (controlled precipitation). It can then be cooled to ambient temperature.

All 14K gold-silver-copper alloys can be annealed at 1200° F. for thirty minutes, followed by a water quench. Heat-treating is carried out in a pre-heating stabilized oven from 500° F. (redder alloys) to 680° F. (pale-yellow alloys) for thirty to sixty minutes.

Best hardening of these types of standard alloys can be produced by cooling slowly in air.

A period of 30 minutes at about 1000° F. followed by a water quench anneals 18K gold-silver-copper alloys. They are then heat-treated in an oven at around 530° F. to 575° F., and cooled in air.

18K nickel-white gold alloys are heat-treatable and suitable as spring-golds. They are annealed at about 1350° F. for 30 minutes and allow to air-cool. Harden at about 800° F. for 60 minutes, then air cool.

In all of the following examples, when heat-treating as-cast shapes, the first step of reducing the metal is eliminated.

EXAMPLES

Alloy No. 1

Reduce metal 75%, anneal at 1350° F. for 30 minutes, cool in air slowly until black and quench in water. Harden at 800° F. for 60 minutes, then air cool.

Alloy No. 2

Reduce metal 75%, anneal at 1022° F. for 30 minutes, then quench in water. Harden at 536° F. for 60 minutes and air cool at a rate of 10° F. per minute.

Alloy No. 3

Reduce metal 50–75%, anneal at 1200° F. for 30 minutes, then quench in water. Harden at 680° F. for 60 minutes and air cool at a rate of 10° F. per minute.

Alloy No. 4

Reduce metal 75%, anneal at 1652° F. for 30 minutes, then quench in water. Harden at 752° F. for 60 minutes, then air cool.

As shown in Table 2 below, an increase in hardness (Vickers) implies an increase in strength and elasticity, as well as a reduction in ductility, of alloys listed above in Table 1.

TABLE 2

| Alloy No. | Cold Worked 75% | Annealed @ Specs | Hardened @ Specs |
|---|---|---|---|
| 1 | 350 | 220 | 300 |
| 2 | 240 | 165 | 325 |
| 3 | 260 | 190 | 270 |
| 4 | 220 | — | 310 |

The foregoing examples are intended to illustrate the features and advantages of the invention without restriction. It is understood that changes and variations can be made in the foregoing without departing from the scope of the invention which is defined in the following claims.

I claim:

1. A method for forming compression spring a mounting structure, which comprises:

forming a quantity of heat-treatable metal into a gemstone mounting having first and second ends, with the first end being spaced from the second end for retaining one or more gemstones therebetween;

annealing the gemstone mounting;

heat-treating the formed mounting to increase the yield strength thereof; and cooling the heat-treated mounting to obtain a compression spring gemstone mounting capable of securely retaining one or more gemstones therein.

2. The method of claim 1 wherein the metal used is a precious metal alloy.

3. The method of claim 1 wherein the metal used is a 14 karat gold alloy.

4. The method of claim 1 wherein the metal used is an 18 karat gold alloy.

5. The method of claim 1 wherein the method used is a platinum alloy.

6. The method of claim 1 wherein the gemstone mounting is formed by working or casting.

7. The method of claim 1 wherein the heat-treatable metal is formed with a gap between the first and second ends of the mounting that is narrower than the width of a gemstone to be mounted therein.

8. The method of claim 7 wherein the gap is defined by walls and which further comprises placing a groove in each wall to form a seat for the gemstone.

9. The method of claim 1 which further comprises configuring the gemstone mounting in the shape of a V, U, or J during the forming step.

10. The method of claim 1 which further comprises applying a force for moving the first and second ends of the heat-treated mounting away from each other; placing one or more gemstones between the first and second ends; and releasing the applied force to allow the ends to securely retain the gemstone or gemstones therebetween.

* * * * *